US008039746B2

(12) United States Patent
Ashida et al.

(10) Patent No.: US 8,039,746 B2
(45) Date of Patent: Oct. 18, 2011

(54) ELECTRIC CONNECTOR AND CABLE

(75) Inventors: Shigeru Ashida, Chiba (JP); Tomoyuki Shinohara, Chiba (JP)

(73) Assignee: Fujikura Ltd., Tokyo (JP)

( * ) Notice: Subject to any disclaimer, the term of this patent is extended or adjusted under 35 U.S.C. 154(b) by 799 days.

(21) Appl. No.: 10/523,829

(22) PCT Filed: Aug. 8, 2003

(86) PCT No.: PCT/JP03/10154

§ 371 (c)(1),
(2), (4) Date: Feb. 8, 2005

(87) PCT Pub. No.: WO2004/015822

PCT Pub. Date: Feb. 19, 2004

(65) Prior Publication Data

US 2005/0255741 A1 Nov. 17, 2005

(30) Foreign Application Priority Data

Aug. 8, 2002 (JP) ..... P2002-231440

(51) Int. Cl.
*H01R 4/00* (2006.01)

(52) U.S. Cl. ..... 174/88 R

(58) Field of Classification Search ..... 174/88 R, 174/117 F; 439/620

See application file for complete search history.

(56) References Cited

U.S. PATENT DOCUMENTS

| | | | | | |
|---|---|---|---|---|---|
| 4,070,084 | A | * | 1/1978 | Hutchison | 439/608 |
| 4,521,064 | A | * | 6/1985 | Knapp et al. | 439/153 |
| 4,834,674 | A | * | 5/1989 | Beamenderfer et al. | 439/494 |
| 4,864,081 | A | * | 9/1989 | Bates | 174/88 R |
| 5,057,650 | A | * | 10/1991 | Urushibata et al. | 174/88 R |
| 5,780,774 | A | * | 7/1998 | Ichikawa et al. | 174/88 R |
| 6,064,003 | A | * | 5/2000 | Moore et al. | 174/65 G |

FOREIGN PATENT DOCUMENTS

| | | | |
|---|---|---|---|
| JP | H02-253584 | A | 10/1990 |
| JP | H05-020944 | A | 1/1993 |
| JP | H06-249871 | A | 9/1994 |
| JP | 2002-190215 | A | 7/2002 |
| JP | 2002-214491 | A | 7/2002 |

* cited by examiner

*Primary Examiner* — Chau Nguyen
(74) *Attorney, Agent, or Firm* — Sughrue Mion, PLLC

(57) ABSTRACT

An electrical connector includes a terminal (11) fixed to a connector housing (10). The electrical connector includes a conductor (23) exposed from a covering (22) and having a connection portion connected to a connection portion of the terminal (11). The electrical connector includes a foam element (31) at a predetermined foam ratio located around respective connection portions of the conductor (23) and the terminal (11).

19 Claims, 11 Drawing Sheets

ELECTRIC CONNECTOR AND CABLE

TECHNICAL FIELD

The invention relates to an electrical connector and a cable, and more particularly relates to an electrical connector and a cable for signal transmission having impedance characteristics.

BACKGROUND ART

An electrical connector has an insulation covered electric wire having the end of a conductor, from which an insulator was removed. The electrical connector has a connection terminal conducted and connected with this end. The connection portion between the end of the conductor and the connection terminal is protected by a plastic connector housing (plastic cover), a polyvinyl chloride resin (PVC) mold, or the like.

With the conductor covered with the insulator, the impedance of the insulation covered electric wire is determined by the permittivity of the insulator. However, the insulator is removed from the terminal of the insulation covered electric wire, and the conductor is exposed to conduct and connect to the connection terminal of the electrical connector. Consequently, the impedance of this terminal becomes different from the impedance of the insulation covered portion.

Even if the connection portion between the end of the conductor and the connection terminal is covered with resin mold, the impedance of the connection portion is determined by complex factors, that is, the shape of the connection portion, the terminal configuration, the permittivity of mold resin material, and the like. Impedance control to a predetermined value is difficult, such as matching of the impedance of the connection portion to the impedance of the insulation covered portion.

Adding to this, a signal transmission cable for high-speed transmission called a high-speed cable is used by virtue of an acceleration of the transmission speed in the interface cable of a computer. This cable requires optimization of the impedance of the electrical connector as a non-conventional electrical characteristic. Thus, the impedance of an electrical connector is controlled to an appropriate predetermined value as needed.

DISCLOSURE OF INVENTION

The mold configuration includes premold (primary mold) of the connection portion between the end of the conductor and the connection terminal. The configuration, having a secondary mold over the premold, becomes the connector product. The primary mold resin employs polyethylene (PE) or polypropylene (PP), for example, is used, or a polyvinyl chloride resin (PVC) of the same quality as the secondary mold resin material.

A basic object of this double mold is to form the primary mold with a selected material which has better electrical characteristics than that of the secondary mold and which is a resin material moldable at a low temperature. Another basic object is to stabilize the mechanical strength of the connection portion between the end of the conductor and the connection terminal. This object is also to mainly improve the mold appearance of the secondary mold. The double mold is, on a rare occasion, used for the purpose of improvement in insulation resistance or withstand pressure as the required performance of the primary mold.

An object of this invention is to provide an electrical connector, which has an impedance controlled to an appropriate predetermined value, thus optimizing the impedance of the electrical connector.

An electrical connector according to the first aspect of the invention includes a terminal fixed to a connector housing. The electrical connector includes a conductor exposed from a covering and having a connection portion connected to a connection portion of the terminal. The electrical connector includes a foam element at a predetermined foam ratio located around respective connection portions of the conductor and the terminal.

According to the first aspect, the impedance of the connection portions of the conductor and the terminal is controlled with the permittivity of the foam element. The permittivity of the foam element is quantitatively determined by the permittivity of matrix and the foam ratio, allowing the impedance of the connection portion according to the foam ratio of the foam element to be arbitrarily set. Thus, the loss on the connection portions is reduced to provide an electrically stable electrical connector.

As a preferred embodiment, the foam element includes a resin, and impedance of the foam element is closer to impedance of the covering, compared with a non-foamed resin.

As a preferred embodiment, the foam element includes a foam resin.

As a preferred embodiment, the foam element functions as a capacitive capacitor.

As a preferred embodiment, respective connection portions of the conductor and terminal are located in a cavity of the connector housing, and the connector housing is made of a foam resin.

As a preferred embodiment, the foam ratio of the foam element is greater than 0% and 80% or less.

As a preferred embodiment, the foam element has strength to maintain a structure thereof.

A method of fabricating an electrical connector according to the second aspect of the invention includes the step of connecting a connection portion of a terminal and a connection portion of a conductor exposed from a covering to each other. The fabrication method includes the step of covering respective connection portions of the terminal and the conductor from therearound with a foam element at a predetermined foam ratio.

According to the second aspect, the conductor is covered with the foam element by one operation, which provides a mechanically stable product.

As a preferred embodiment, the foam element is controlled in impedance to be approximate to the covering.

As a preferred embodiment, the foam element is molded to cover respective connection portions.

As a preferred embodiment, the foam element is formed into a predetermined shape to be fitted to respective connection portions.

As a preferred embodiment, the foam element is formed as a tape to be wound around respective connection portions.

An electrical connector according to the third aspect of the invention includes a cable. This cable includes an electric wire including a conductor exposed from a first covering. The cable includes a drain wire arrayed parallel to the electric wire. The cable includes a jacket holding the electric wire and the drain wire. The electrical connector includes a connection terminal having a connection portion connected to an end of the conductor. The electrical connector includes an earth terminal having a connection portion connected to an end of the drain wire. The electrical connector includes a connector housing receiving the connection terminal and the earth terminal. The electrical connector includes a foam resin located around the end of the conductor, the connection portion of the connection terminal, the end of the drain wire and the connection portion of the earth terminal. The electrical connector includes a second covering located around the foam resin.

A cable according to the fourth aspect of the invention has an electric wire having a conductor exposed from a covering. The cable has a connector including a terminal having a connection portion connected to a connection portion of the conductor and fixed to a connector housing. The cable includes a foam element at a predetermined foam ratio located around respective connection portions of the conductor and the terminal.

A connector for a signal transmission cable according to the fifth aspect of the invention includes a connector housing. The connector includes a terminal fixed to the connector housing. The connector includes a cable conductor electrically connected to the terminal by welding within the connector housing. The cable includes a foam element covering a connection portion of the terminal and the cable conductor within the connector housing.

As a preferred embodiment, the connection portions include a molten alloy layer.

A method of fabricating a connector for a signal transmission cable according to the sixth aspect of the invention includes the step of welding a terminal and a cable conductor to each other for connection. The fabrication method includes the step of preparing a foamable resin. The fabrication method includes the step of locating connection portions of the terminal and the cable conductor in a die; feeding the foamable resin into the die for extrusion to cover the connected terminal and the conductor from therearound with a foam element at a predetermined foam ratio, thus to form a connector housing in a predetermined shape.

A method of fabricating a connector for a signal transmission cable according to the seventh aspect of the invention includes the step of welding a terminal and a cable conductor to each other for connection. The fabrication method includes the step of fitting said pair of covering members around the connection portions of the terminal and the cable conductor. The fabrication method includes the step of molding a resin for the connector housing around the terminal, the foam resin, and the cable conductor exposed from a covering, thus to form a connector housing in a predetermined shape.

A method of fabricating a connector for the signal transmission cable according to the eighth aspect of the invention includes the step of welding a terminal and a cable conductor for connection. The fabrication method includes the step of preparing a foam resin tape. The fabrication method includes the step of winding the foam resin tape a predetermined number of times around connection portions of the terminal and the cable conductor to cover the connection portions. The fabrication method includes the step of molding a resin for a connector housing around the terminal, the foam resin tape, and the cable conductor exposed from a covering, thus to form a connector housing in a predetermined shape.

BEST MODE FOR CARRYING OUT THE INVENTION

With reference to the attached drawings, embodiments of this invention are hereunder described in detail.

Figure 1:
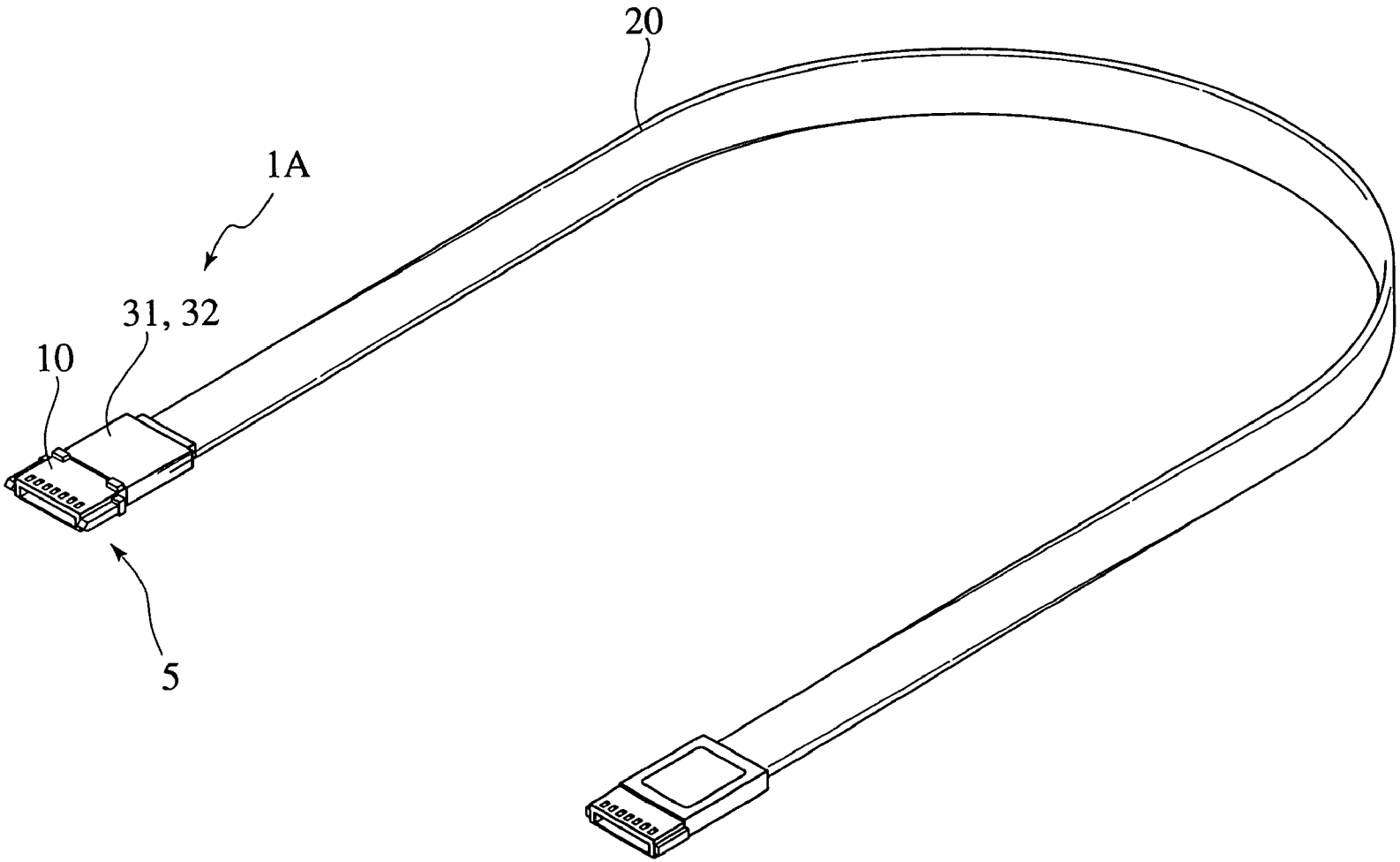
FIG. 1 is a perspective view of a cable according to the first embodiment of the invention.

Referring to FIG. 1, a cable 1A of a first embodiment includes electrical connectors 5 and an assembled cable 20 which are connected to each other. The connector 5 includes a resin connector body or a connector housing 10. The connector 5 includes a plurality of parallel-arranged connection terminals 11 within the connector housing 10. The terminals 11 have contacts 11*a* protruding from the connector housing 10.

The connector housing 10 has dimensions of, for example, 12 times $10^{-3}$ m in the longitudinal direction, 14 times $10^{-3}$ m in the transverse direction, and 3.5 times $10^{-3}$ min the thickness of the terminal 11. The contacts 11*a* of the terminals 11 protrudes from the connector housing 10, with a length of, for example, 2.6 times $10^{-3}$ m. The distance between contacts 11*a*, for example, is 1.27 times $10^{-3}$ m.

Figure 2:
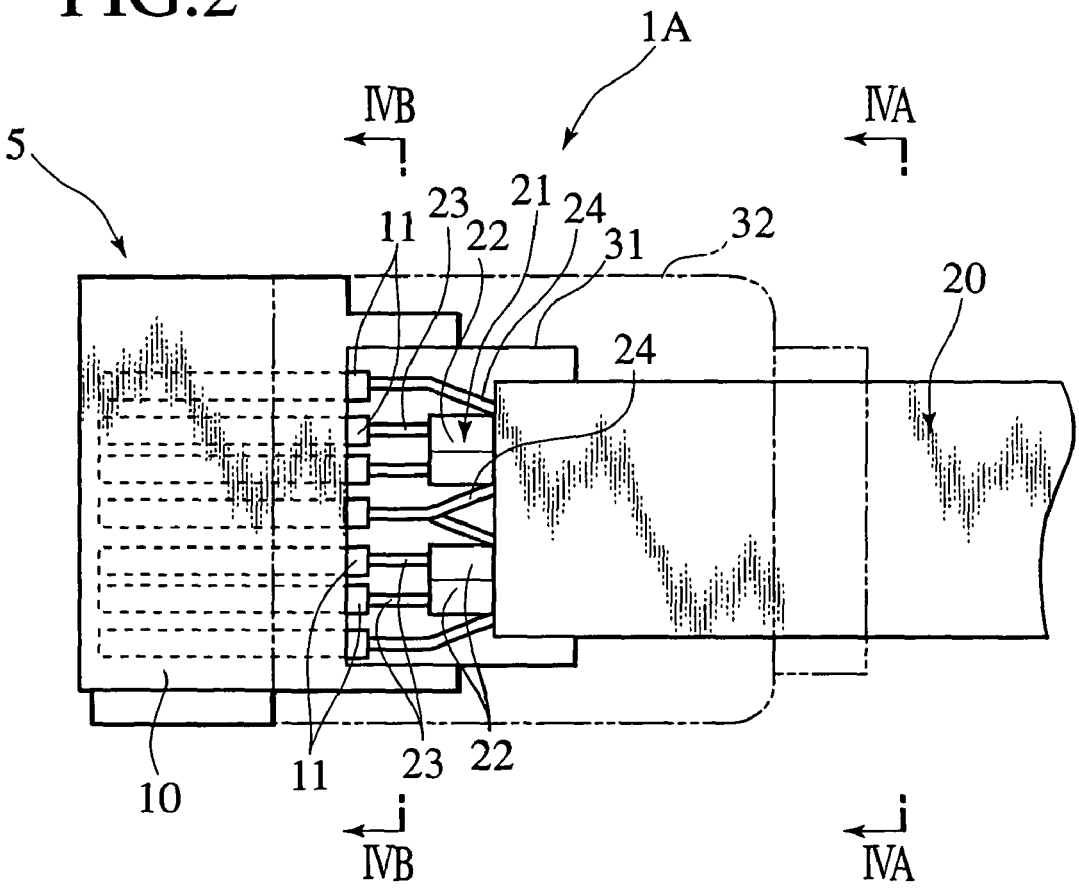
FIG. 2 is a plan view of an electrical connector of FIG. 1.
Figure 3:
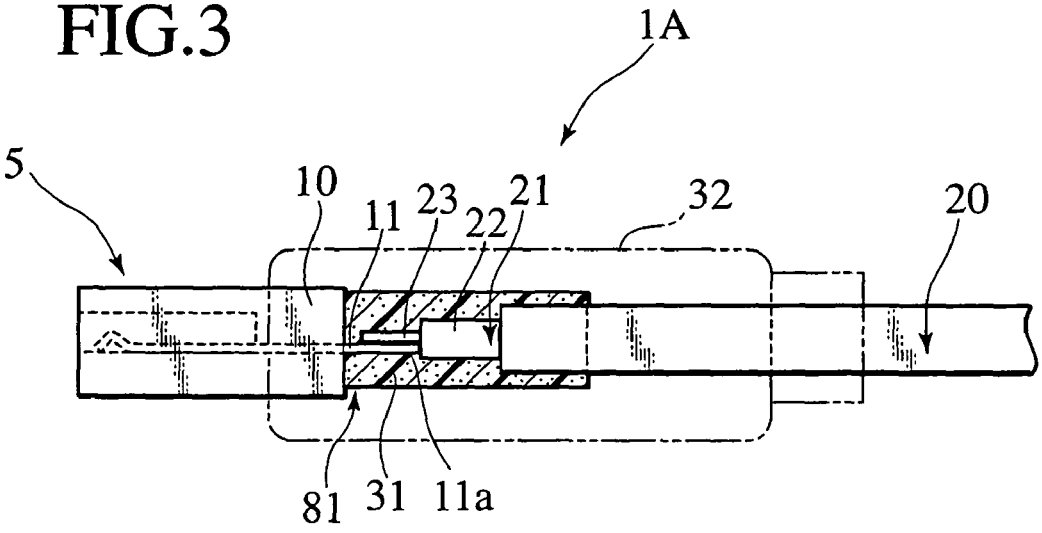
FIG. 3 is a side view of the electrical connector of FIG. 1.
Figure 4A:
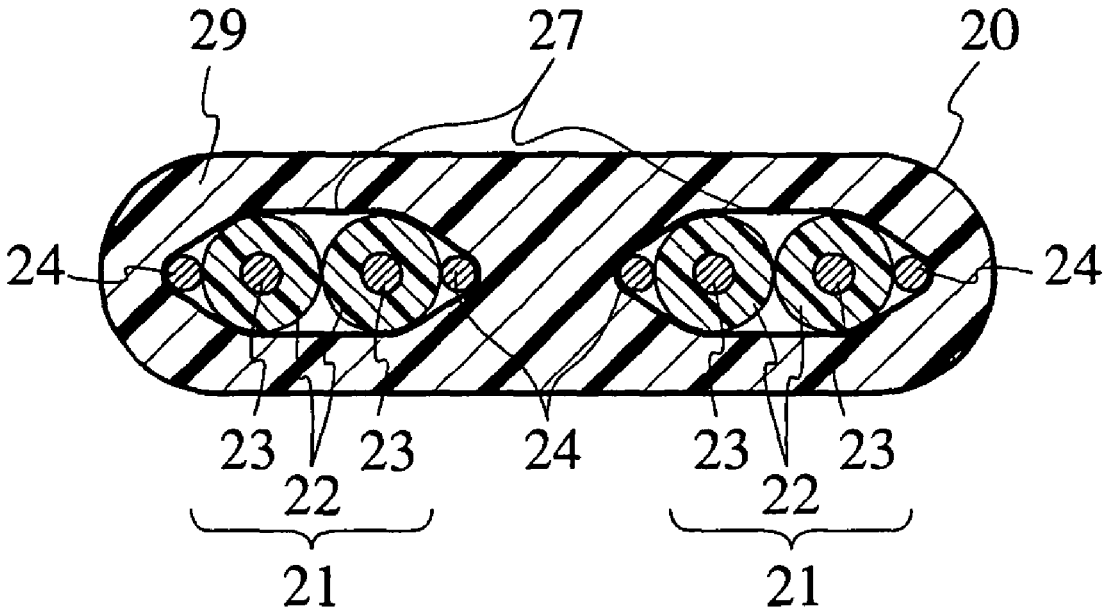
FIG. 4A is a sectional view taken along IVA-IVA of FIG. 2.
Figure 4B:
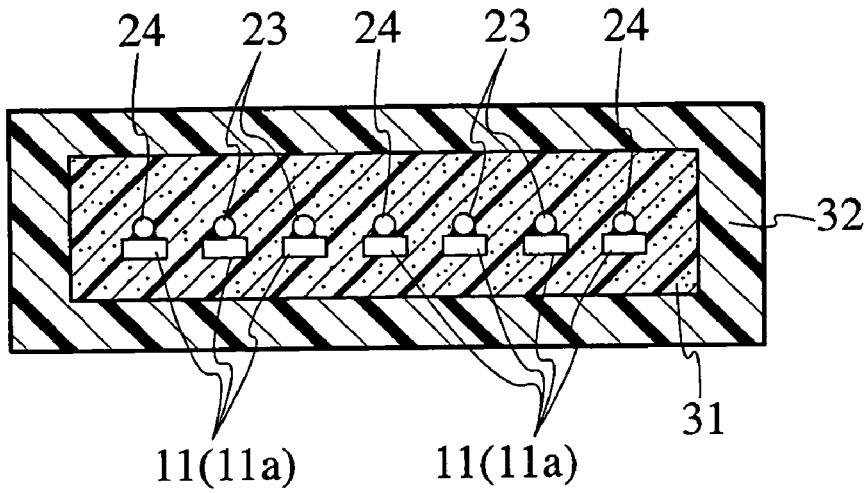
FIG. 4B is a sectional view taken along IVB-IVB of FIG. 2.
Figure 4C:
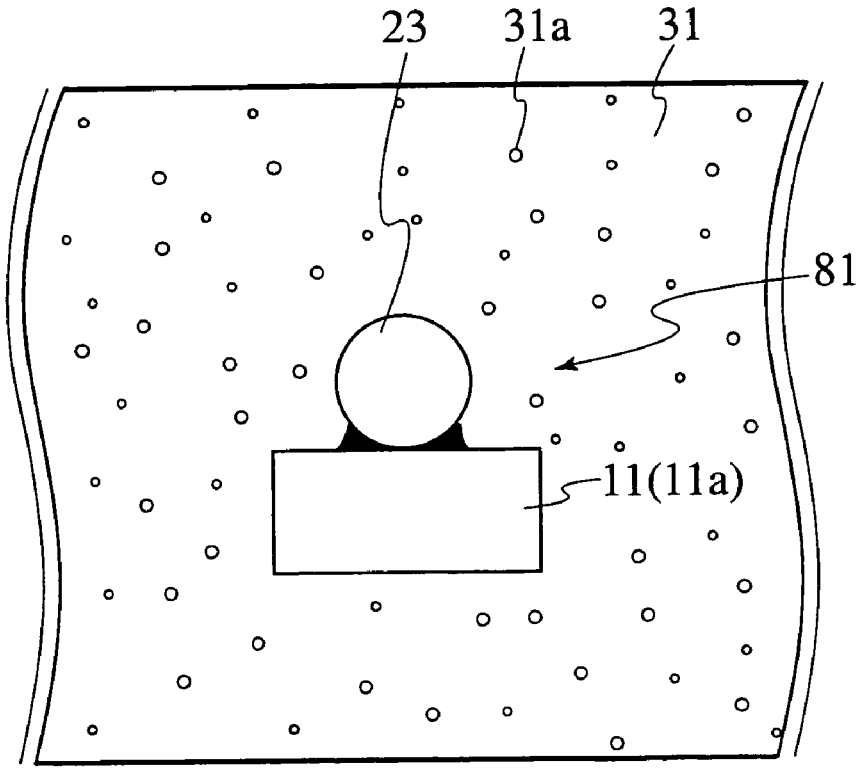
FIG. 4C is an enlarged view of a connection portion of FIG. 4B.

Referring to FIG. 4A, the cable 20 includes two sets of insulation covered electric wires 21 arranged in parallel with each other. The covered electric wire 21 includes conductors 23 covered with an insulator 22. Each of the covered electric wires 21 includes bare wire drain wires 24 on the sides. The drain wires 24 and the covered electric wire 21 are enclosed by aluminum foil 27. The cable 20 includes a jacket 29 sheathing around the foil 27. At the end portion of the covered electric wire 21, the insulator 22 is removed to expose the end of the conductor 23. Referring to FIGS. 2 and 3, the end of the conductor 23 is also connected to a corresponding connection terminal 11, using soldering or spot welding. The end of the drain wire 24 is connected with a corresponding earth terminal 11 by soldering or spot welding. Referring to FIG. 4B and FIG. 4C, the contact 11*a* of the connection terminal 11 and the end of the conductor 23 have a connection portion 81. The end of the earth terminal 11 and the drain wire 24 have a connection portion. The connection portion 81 and the connection portion include the region of the cable or the covered electric wire in which part or the whole of the covering (including a cable jacket) is removed, and the region of the terminal of the connector connected to the conductor of the region.

With regard to the connection portion 81 between the connection terminal 11 and the conductor 23, and the connection portion between the earth terminal 11 and the drain wire 24, the whole thereof is, as its primary molding, collectively covered by molding with a molded foam resin 31. In other words, the foam resin 31 is filled around the conductor 23, the drain wire 24, the connection terminal 11, and the earth terminal 11. The foam resin 31 includes uniformly dispersed gas bubbles 31*a*. The gas bubbles 31*a* function as a capacitance or impedance control means.

The electrical connector 5 is further covered by molding resin 32, such as polyvinyl chloride, as its secondary molding, thereby forming the product into a shape.

The foam resin 31 is foamed polyurethane, foamed polystyrene, foamed polypropylene, foamed polyethylene, foamed polyvinyl chloride, foamed ABS resin, foamed urea resin, foamed phenol resin, or the like. The foam ratio of the resin 31 is set according to the required impedance. The foam ratio means the ratio (%) of the gas bubble to the whole cubic volume. The foam ratio is measured by Archimedes' principal as in the case of porosity.

The permittivity of the foam resin 31 is quantitatively determined by the permittivity and the foam ratio of the resin material itself of the foam resin 31. Therefore, the foam ratio of the foam resin 31 sets the impedance of the connection portion 81 between the end of the conductor 23 and the contact 11*a* of the connection terminal 11 at a desired value. Moreover, coincidence of the impedance in the connection portion 81 with approximation to the impedance of coverings 22 and 29 reduces any loss on the connection portion 81.

Figure 5:
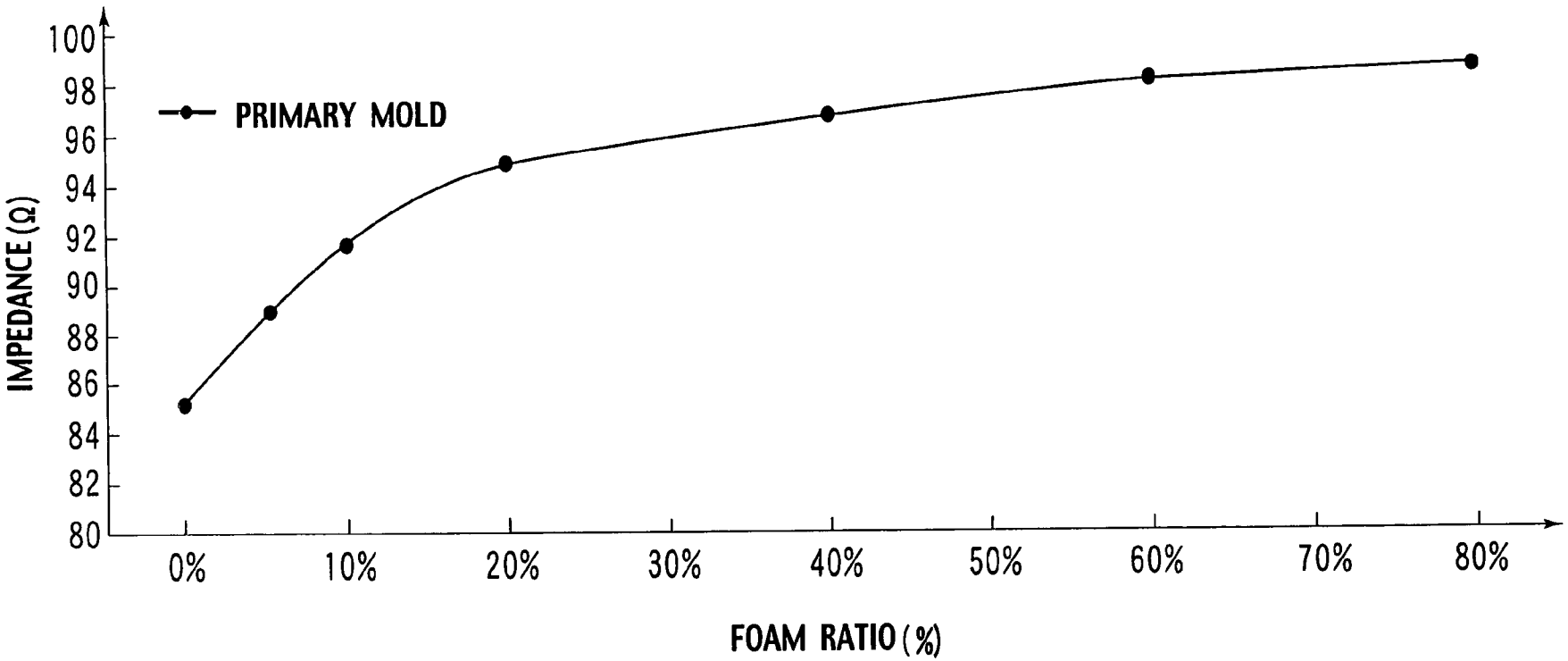
FIG. 5 is a graph illustrating the impedance versus foam ratio of a foam resin.

Referring to FIG. 5, experiments on the relationship between foam ratio of the foam resin and impedance in the primary mold of the cable 1A were performed. As raw materials, polypropylene and foaming agent were mixed at a predetermined weight ratio, which was foamed. In this experimental example, in the case where the weight ratios of polypropylene and the foaming agent were 100 to 0, 97 to 3, 95 to 5 and 93 to 7, foam ratios were 0%, 5%, 10%, and 20% in order. As for the impedance, the minimum value in the measured values was adopted.

As a result, the impedance increased in the foam ratio from 0 to 15% at a given slope. The foam ratio over 15% gradually reduced the slope of the impedance. The foam ratio over 60% rendered the impedance approximately constant.

The impedance of the foam resin with a foam ratio of 20% or more approached approximately 100Ω as a standard value of covering impedance. Therefore, the foam ratio is preferably 20% or more. On the other hand, in terms of achieving high strength of the foam resin, the foam ratio is preferably 60% or less. The foam ratio over 80% causes insufficient strength, which is unable to maintain the mold structure of the foam resin.

From the above, it was confirmed that adjustment of the foam ratio of the foam resin allows for control of the impedance. This is generally based on the inverse proportion of characteristic impedance to the square root of $\epsilon$ (permittivity). In other words, if the shape factor of the foam resin is specified in advance, selection of the permittivity of the foam resin with the foam ratio uniquely determines the impedance.

Figure 6:
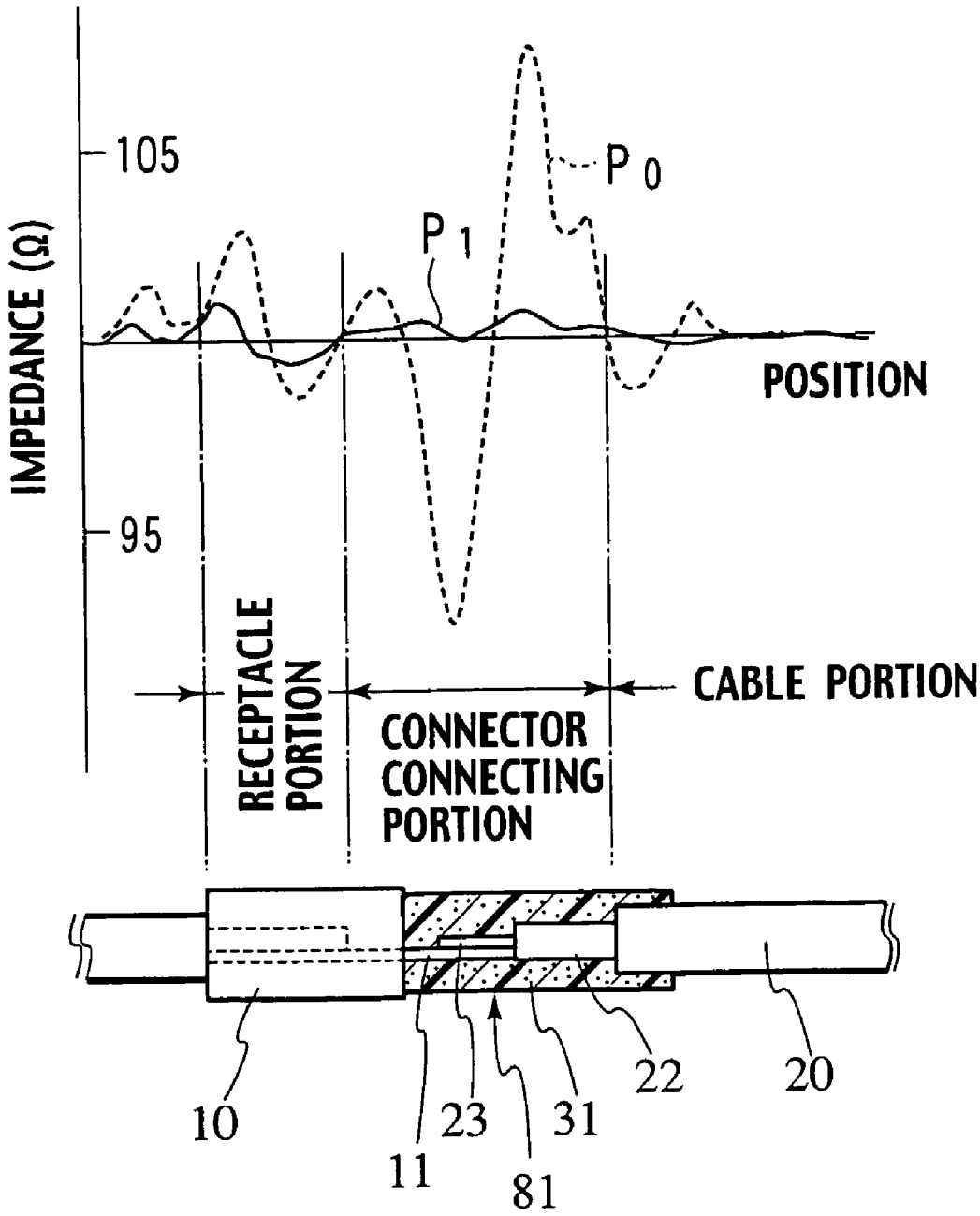
FIG. 6 is a view illustrating the impedance profile of the electrical connector of FIG. 3.

Referring to FIG. 6, the impedance profile of the cable 1A is described. The impedance was measured in the longitudinal direction of the cable 1A, using time domain reflectometry (TDR).

The abscissa axis indicates the positions respectively corresponding, from the left to the right, to a board, a connector housing 10, a cable 20, a primarily molded connection portion 81, a covered electric wire 22, a cable 20. The ordinate axis indicates the impedance. $P_1$ is the impedance profile of the cable 1A covered with the foam resin 31. The impedance of the board is 107.8Ω. The impedance of the cable 20 is 99.5Ω. The impedance of the connection portion 81 and the periphery thereof indicates values close to the impedance of the cable 20. The significant variation in the impedance in the connector housing 10 arises from the connection between the connection terminal 11 and the board. On the other hand, $P_0$ is the impedance profile of the cable 1A in which the connection terminal 11 of the connection portion 81 and the conductor 23 are not covered. The peaks of 5Ω or more to the cable were identified in the connection portion 81 of connection terminal 11 and the conductor 23, and the periphery thereof.

Figure 7:
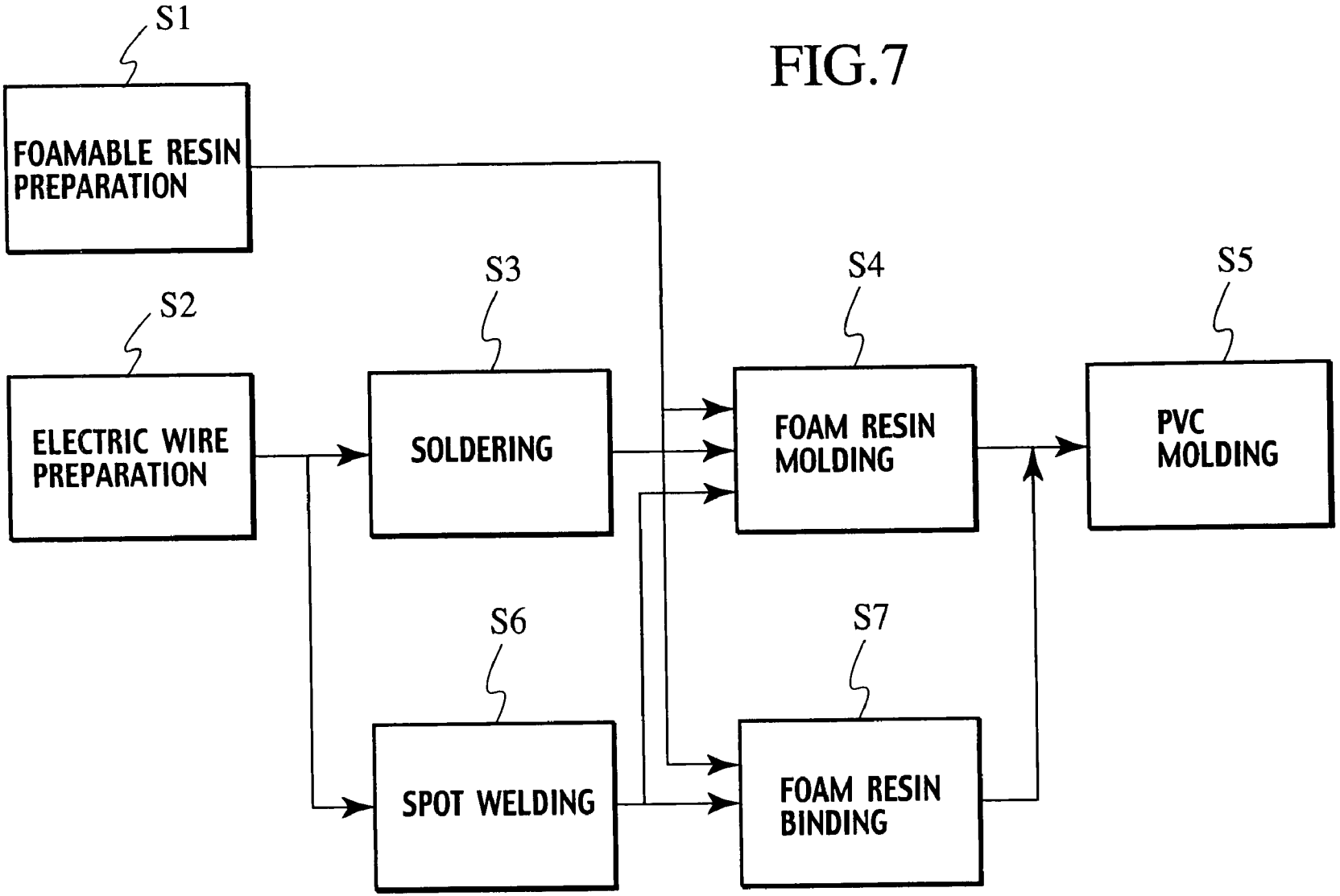
FIG. 7 is a block diagram illustrating the method of covering a connection portion of FIG. 3.

Referring to FIG. 7, the covering method in the connection portion is described.

A foaming agent and a resin are mixed at a predetermined weight ratio to prepare a foamable resin (S1). The foaming agent employs, for example, ADCA (Azodicarbonamide), DPT (Dinitrosopentamethyleneteramin) or, OBSH (benzenesulfonylhydrazide).

At the end portion of the cable 20, the jacket 29 is given a cut-in and is removed to expose a covered electric wire 21. The insulator 22 of the covered electric wire 21 is removed to expose a conductor 23(S2). The end of the conductor 23 and the contact 11*a* of the terminal 11 are soldered to each other to form a connection portion 81. The drain wire 24 and the earth terminal 11 are soldered to form a connection portion (S3).

The connection portion 81 is placed in a die. With pressure and heat (approximately from 150 degrees Celsius to 250 degrees Celsius) applied, the foamable resin is fed into the die for extrusion. During the extrusion, the foaming agent reacts to produce gas bubbles, turning the foamable resin into the foam resin 31. The foam resin 31 is filled around the connection terminal 11 and the conductor 23 of the connection portion 81, and around the drain wire 24 and the earth terminal 11. This step forms a primary mold (S4). Next, PVC (polyvinyl chloride) is molded around the foam resin 31, the covered electric wire 21 and the connector housing 10 to form a secondary mold 32 in a predetermined shape (S5).

As another method, the connection terminal and the conductor 23 are spot welded to form the connection portion 81 (S6).

Figure 8A:
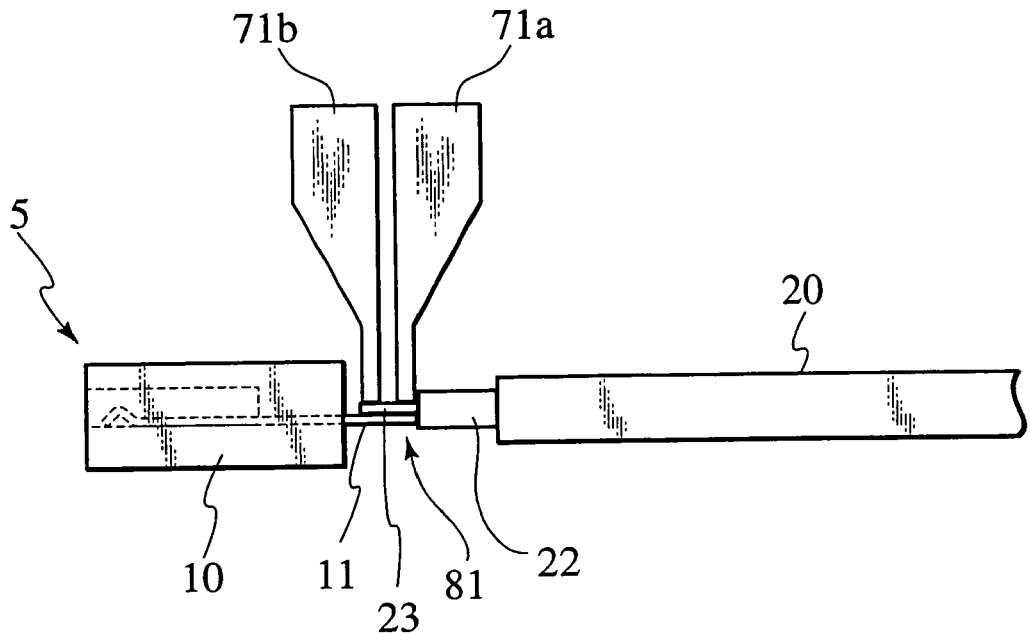
FIGS. 8A and 8B are side views for illustrating spot welding of FIG. 7.
Figure 8B:
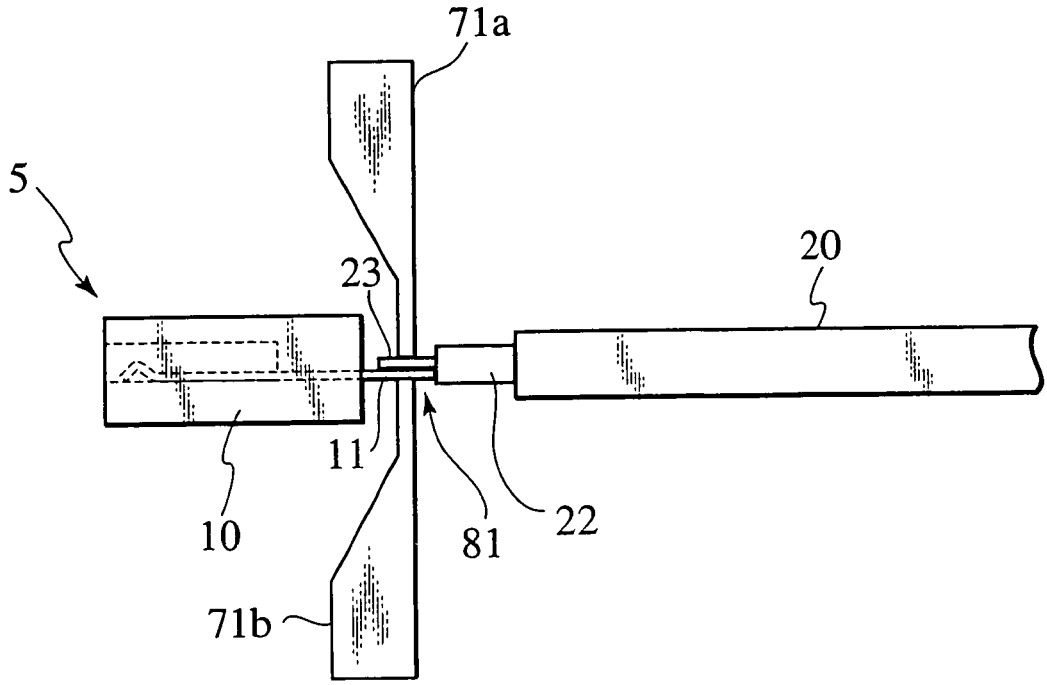

Referring to FIGS. 8A and 8B, the spot welding is described. In FIG. 8A, the connecting device includes a pair of electrodes 71 having a positive electrode 71*a* and a negative electrode 71*b*, which are spaced from each other. The electrodes 71*a* and 71*b* are movable in the vertical direction. Alternatively, in FIG. 8B, a pair of electrodes 71*a* and 71*b* may respectively have the terminal 11 and the conductor 23 to be connected, interposed therebetween from the above and below. The pair of electrodes 71*a* and 71*b* are movable in the vertical direction, respectively.

With the electrodes 71*a* and 71*b* pressed against the conductor 23 toward the connection terminal 11, current is applied between the electrodes 71*a* and 71*b* through the conductor 23 and the connection terminal 11. In this process, current is applied through the surface contact resistance between the conductor 23 and the connection terminal 11 to produce intense heat. The intense heat melts the contact surface between the connection terminal 11 and the conductor 23, and forms what is called a nugget, which is a molten alloy layer, (when the cable conductor 23 is plated with silver, the molten alloy becomes silver-copper alloy). This nugget connects the connection terminal 11 and the conductor 23 to each other, forming a connection portion 81.

After that, in Step S4, the connection portion 81 is placed in the die, and the foamable resin is fed into the die for extrusion, with pressure and heat (approximately 150 degrees Celsius to 250 degrees Celsius) applied, forming a primary mold. Next, in Step S5, PVC (polyvinyl chloride) is molded around the foam resin 31 to form the secondary mold 32 in a predetermined shape.

Figure 11:
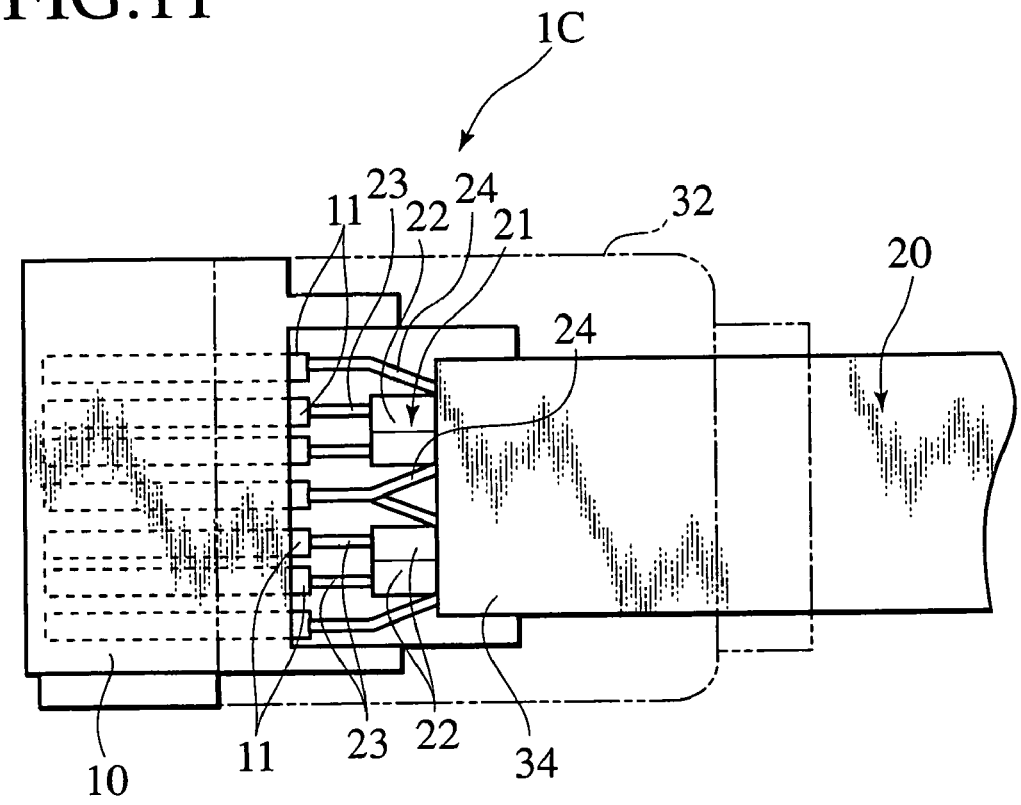
FIG. 11 is a plan view of an electrical connector according to the third embodiment of the invention.
Figure 12:
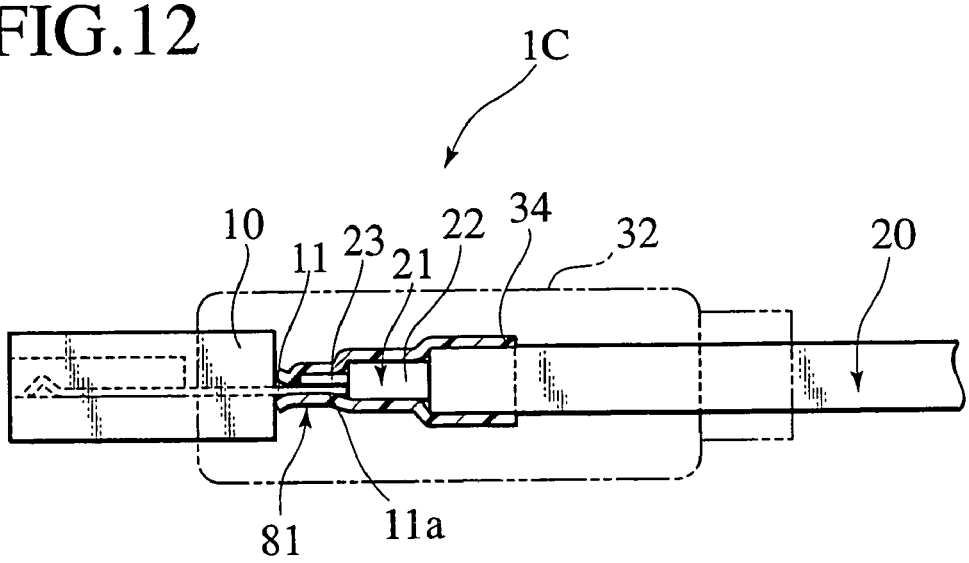
FIG. 12 is a side view of the electrical connector of FIG. 11.

Note that, in place of molding (S4), the foam resin tape may be wound around this connection portion 81, and the terminal 11 and conductor 23 in the periphery thereof (Refer to S7 and FIGS. 11 and 12).

With the above, setting of foam ratio of the foam resin 31 to an appropriate predetermined value controls the impedance of the electrical connector 5. This control of the embodiment optimizes the impedance of the electrical connector 5 as required.

Further, the spot welded connector achieves the following advantages, compared with a solder welded connector.

1. Formation of the alloy layer in the contact by welding allows the structure or the composition between the cable conductor and the contact to be gradually or continuously changed. This suppresses signal reflection and the like and reduces attenuation when a high frequency signal is transmitted between the conductor and the contact.

2. Particularly, the transmission signal with a frequency of 1000 MHz (1 GHz) or more significantly reduces connection loss on weld cable, compared with soldered cable. The frequency of 2500 MHz (2.5 GHz) or more allows for the difference between both to be more remarkable.

3. The crosstalk among signal lines is significantly reduced. To be more specific, for example, when a noise signal with a voltage of 6 V is applied through the neighboring signal line, the ratio in occurrence of errors in a soldered connecting signal line is 1 bit to about 1000 bits, while the ratio in occurrence of errors in a weld signal line is 1 bit to about $10^7$ bits. For this reason, the ratio in occurrence of errors in a weld signal line is significantly reduced compared with the ratio in occurrence of errors in a soldered signal line.

4. The joint strength increases.

5. The smaller electrical loss allows the transmission speed to be at a higher speed.

6. The transmission characteristics (impedance, crosstalk, and the like) are stabilized.

Second Embodiment

Figure 9:
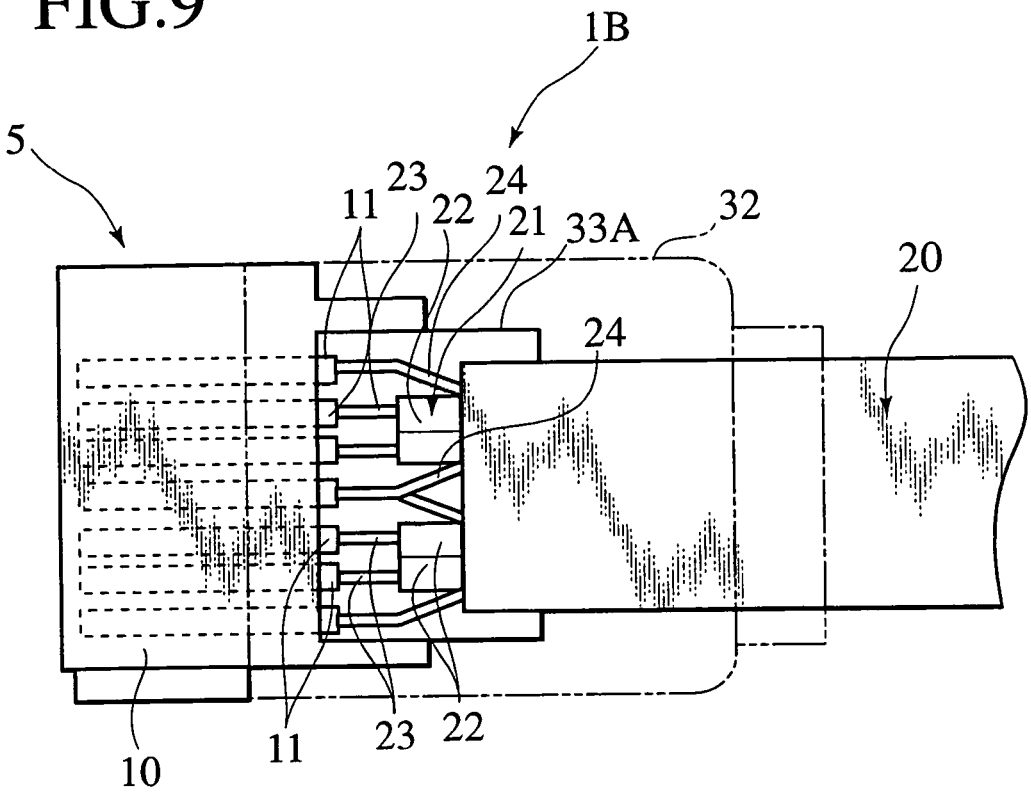
FIG. 9 is a plan view of an electrical connector according to the second embodiment of the invention.
Figure 10:
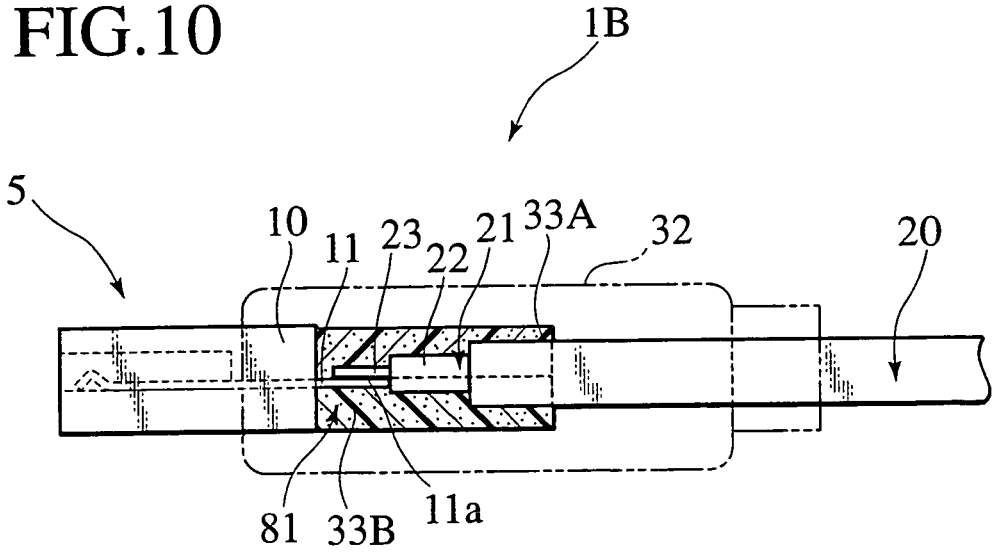
FIG. 10 is a side view of the electrical connector of FIG. 9.

Referring to FIG. 9 and FIG. 10, a cable 1B of a second embodiment is described. Hereunder, members and parts corresponding to FIG. 2 and FIG. 3 are designated by the identical reference numerals and codes, and the description is omitted.

An electrical connector 5 includes a pair of covering parts 33A and 33B separated into halves. The parts 33A and 33B are formed in such shapes in advance so as to conform to the shape of a connection portion 81 between a connection terminal 11 and the end of a conductor 23, as well as the connection portion between an earth terminal 11 and the end of a drain wire 24. The covering parts 33A and 33B are covered and fitted to the whole of respective connection portions 81.

In this embodiment, setting of the foam ratio of the foam resin constituting the covering part half bodies 33A and 33B controls the impedance of the electrical connector 5 to an appropriate predetermined value. This embodiment optimizes the impedance of the electrical connector 5 according to requirements, similarly to embodiment 1.

Third Embodiment

Referring to FIG. 11 and FIG. 12, a cable 1C of a third embodiment is described.

On an electrical connector 5, a foam resin tape 34 is wound and fitted around a connection portion 81 between a connection terminal 11 and the end of a conductor 23, as well as a connection portion between an earth terminal 11 and an end of a drain wire 24. The entire connection portion 81 is covered with foam resin tape 34.

In this embodiment, setting of the foam ratio of the foam resin constituting the foam resin tape 34 appropriately controls the impedance of the electrical connector 5 to a predetermined value. This embodiment optimizes the impedance of the electrical connector 5 according to requirements similarly to embodiment 1.

Fourth Embodiment

Figure 13:
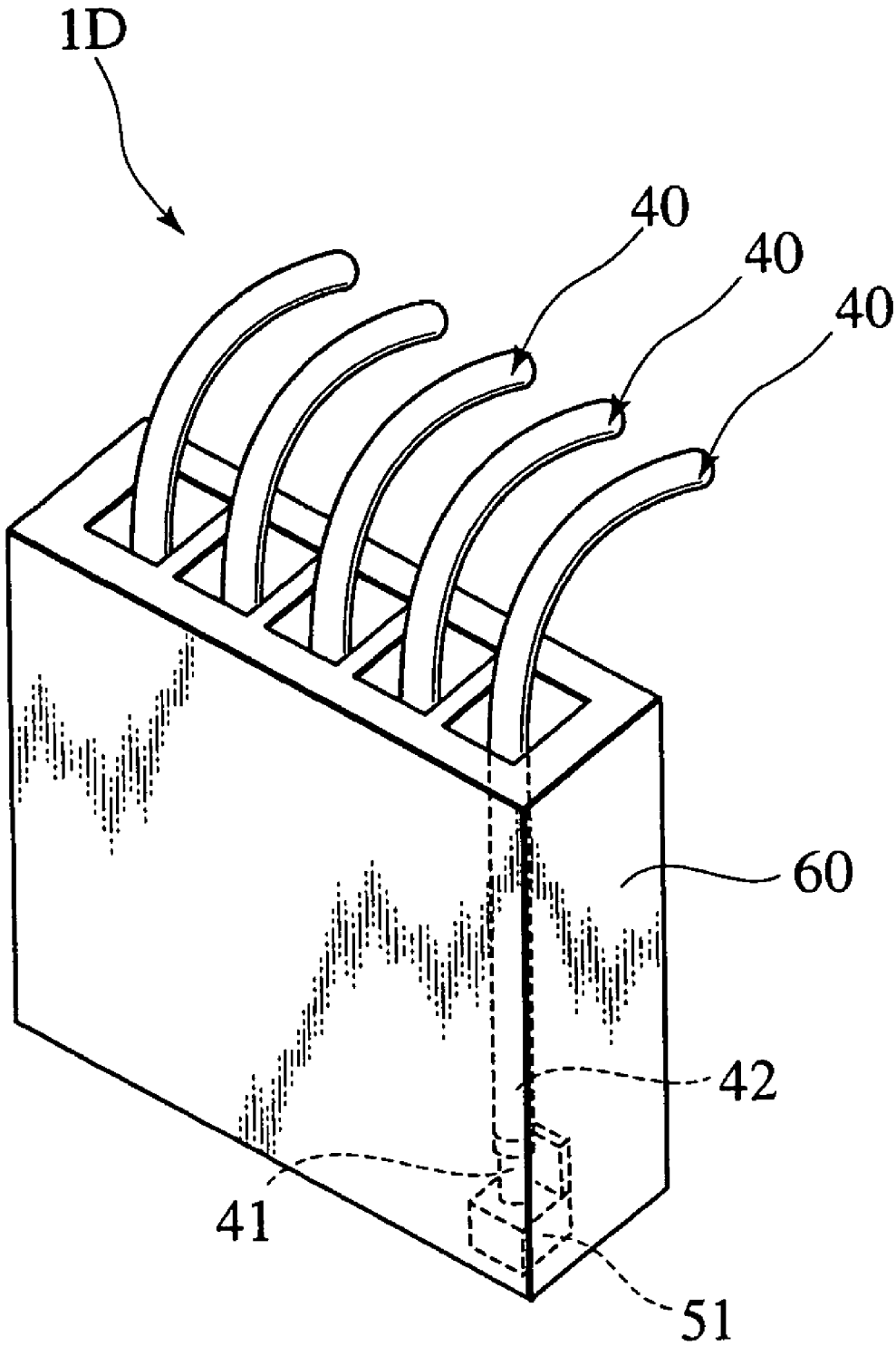
FIG. 13 is a perspective view of an electrical connector according to the fourth embodiment of the invention.

Referring to FIG. 13, a cable 1D of a fourth embodiment is described.

An electrical connector 1D includes an insulation covered electric wire 40, comprising a conductor 41 covered with an insulator 42. The conductor 42 at the end portion of the covered electric wire 40 is removed to expose a conductor 41. The end of the exposed conductor 41 has a solderless terminal 51 crimped thereto. Together with the solderless terminal 51, the end of the covered electric wire 40 is inserted into and fitted in a connector housing 60.

The connection portion between the end of the conductor 41 of the covered electric wire 40 and the solderless terminal (connection terminal) 51 is housed within the connector housing 60. The connector housing 60 is made from a foam resin in which the foam ratio has been adjusted.

Thus, in this embodiment, setting of the foam ratio of the foam resin constituting the connector housing 60 appropriately controls the impedance of the electrical connector 5 to a predetermined value. For this reason, this embodiment optimizes the impedance of the electrical connector according to requirements similarly to embodiment 1.

INDUSTRIAL APPLICABILITY

The electrical connector and cable of this invention are useful for connection with electrical machineries and apparatus in the field of information communications, electronics, or automobiles. Furthermore, the connector with lower loss is useful for electrical machineries and apparatus with a number of connection positions.

This invention is not limited to the embodiments, and variations and modifications thereof can be made by the knowledge level of those skilled in the art.

Contents of Japanese patent application 2002-231440 (filed Aug. 8, 2002) are incorporated by reference in this application.

The invention claimed is:

1. An electrical connector comprising:

a conductor exposed from a covering;

a connection portion of the conductor connected to a connection portion of a terminal;

a connector housing receiving the terminal;

an impedance control means fixed on the connection portions of the conductor and the terminal; and a second covering that covers a part of the covering, the impedance control means and a part of the connector housing, wherein the impedance control means is a foam resin controlling an impedance in terms of a foam ratio that is selected so that an impedance of the connection portions substantially match the impedance of the covering of the conductor.

2. The electrical connector according to claim 1, wherein the foam resin functions as a capacitive capacitor.

3. The electrical connector according to claim 1, wherein respective connection portions of the conductor and the terminal are located in a cavity of the connector housing, wherein the connector housing is made of a foamed resin.

4. The electrical connector according to claim 1, wherein the foam ratio is greater than 0% and 80% or less.

5. The electrical connector according to claim 1, wherein the foam resin has strength to maintain a structure thereof.

6. An electrical connector according to claim 1, wherein the foam resin fills a surrounding space defined by the connection portions and the second covering.

7. A method of fabricating an electrical connector, comprising:

connecting a connection portion of a terminal and a connection portion of a conductor exposed from a covering to each other;

receiving the terminal in a connector housing;

fixing impedance control means on the connection portions of the conductor and the terminal; and covering a part of the covering, the impedance control means and a part of the connector housing with a second covering;

wherein the impedance control means is a foam resin controlling an impedance in terms of a foam ratio that is selected so that an impedance of the connection portions substantially match the impedance of the covering of the conductor.

8. The method of fabricating an electrical connector according to claim 7, wherein the foam resin is controlled to be approximate in impedance to the covering.

9. The method of fabricating an electrical connector according to claim 7, wherein the foam resin is molded to cover respective connection portions.

10. The method of fabricating an electrical connector according to claim 7, wherein the foam resin is formed into a predetermined shape to be fitted to respective connection portions.

11. The method of fabricating an electrical connector according to claim 7, wherein the foam resin is formed as a tape to be wound around respective connection portions.

12. An electrical connector comprising:

a cable comprising:

an electrical wire including a conductor exposed from a first covering;

a drain wire arrayed parallel to the electric wire; and a jacket holding the electric wire and the drain wire;

a connection terminal having a connection portion connected to an end of the conductor;

an earth terminal having a connection portion connected to an end of the drain wire;

a connector housing receiving the connection terminal and the earth terminal; and a second covering located around a foam resin, wherein the foam resin is configured to control an impedance in terms of a foam ratio that is selected so that an impedance of the connection portion substantially matches an impedance of a the first covering.

13. A cable comprising:

an electric wire having a conductor exposed from a covering;

a connection portion of the electric wire connected to a connection portion of a terminal;

a connector housing receiving the terminal;

a foam element fixed on the connection portions of the electric wire and the terminal; and a second covering that covers a part of the covering, the foam element and a part of the connector housing, wherein the foam element is a foam resin controlling an impedance in terms of a foam ratio that is selected so that an impedance of the connection portions substantially match the impedance of the covering of the electric wire.

14. A connector for a signal transmission cable, comprising:

a connector housing;

a terminal fixed to the connector housing;

a cable conductor exposed from a covering and electrically connected to the terminal by welding within the connector housing;

an impedance control means fixed on a connection of the terminal and the cable conductor; and a second covering that covers a part of the covering, the impedance control means and a part of the connector housing, wherein impedance control means is a foam resin controlling an impedance in terms of a foam ratio that is selected so that an impedance of the connection of the terminal and the cable conductor substantially match the impedance of the covering of the cable conductor.

15. The connector for a signal transmission cable according to claim 14, wherein the connection portions include a molten alloy layer.

16. The method of fabricating a connector for a signal transmission cable, comprising:

welding a terminal and a cable conductor having a covering to make a connection portion;

inserting the terminal in a housing;

preparing a foamable resin;

locating connection portions of the terminal and the cable conductor in a die;

feeding the foamable resin into the die for extrusion to cover the connection portion with a foam element;

forming a second covering that covers a part of the covering, the foamable resin and a part of the housing, wherein foamable resin is configured to control an impedance in terms of a foam ratio that is selected so that an impedance of the connection portions of the terminal and the cable conductor substantially match the impedance of the covering of the cable conductor.

17. A method of fabricating a connector for a signal transmission cable, comprising:

welding a terminal and a cable conductor to each other for connection;

forming a pair of foam resin covering members preliminarily formed into shapes which conform to an upper half shape and a lower half shape of connection portions of the terminal and the cable conductor;

fitting said pair of covering members around the connection portions of the terminal and the cable conductor; and molding a resin for a connector housing around the terminal, the pair of foam resin covering members, and the cable conductor exposed from a covering, thus to form the connector housing in a predetermined shape, wherein the foam resin configured to control an impedance in terms of a foam ratio that is selected so that an impedance of the connection of the terminal and the cable conductor substantially match the impedance of the pair of covering members.

18. The method of fabricating a connector for a signal transmission cable, according to claim 17, wherein the foam resin has a predetermined foam ratio selected to substantially match the impedance of the connection portions with a covering of the cable conductor.

19. A method of fabricating a connector for a signal transmission cable, comprising:

welding a terminal and a cable conductor for connection;

preparing a foam resin tape;

winding the foam resin tape a predetermined number of times around connection portions of the terminal and the cable conductor to cover the connection portions;

molding a resin for a connector housing around the terminal, the foam resin tape, and the cable conductor exposed from a covering, thus to form a connector housing in a predetermined shape, wherein the foam resin tape is configured to control an impedance in terms of a foam ratio that is selected so that an impedance of the connection of the terminal and the cable conductor substantially match the impedance of the covering of the conductor.

* * * * *